US005471701A

United States Patent [19]

Parfenie

[11] Patent Number: 5,471,701

[45] Date of Patent: Dec. 5, 1995

[54] TOOTHBRUSH WITH EJECTABLE HEAD

[76] Inventor: Mihai Parfenie, 214-1860 West 2nd Avenue, Vancouver, British Columbia, Canada, V6G 1H9

[21] Appl. No.: 351,122

[22] Filed: Nov. 30, 1994

[51] Int. Cl.[6] ..... A46B 9/04

[52] U.S. Cl. ..... 15/167.1; 15/145; 15/176.1; 15/176.6; 403/325; 403/329

[58] Field of Search ..... 15/145, 167.1, 15/167.2, 176.1–176.6; 403/321, 325, 327, 329

[56] References Cited

U.S. PATENT DOCUMENTS

| | | | |
|---|---|---|---|
| 380,080 | 3/1888 | Bouton et al. | 15/167.1 |
| 1,059,508 | 4/1913 | Watt | 15/176.5 |
| 1,731,751 | 10/1929 | Neissl | 15/176.1 |
| 1,794,711 | 3/1931 | Jacobs | 15/176.1 |
| 1,859,425 | 5/1932 | Bell . | |
| 1,879,553 | 9/1932 | Silva et al. | 15/176.1 |
| 2,111,880 | 3/1938 | Waters . | |
| 2,228,754 | 1/1941 | Cosby . | |
| 2,232,269 | 2/1941 | Reuben | 15/167.1 |
| 2,489,582 | 11/1949 | McCready | 15/176.5 |
| 2,638,614 | 5/1953 | Anderson . | |
| 2,668,973 | 2/1954 | Glaza et al. . | |
| 2,712,151 | 7/1955 | Becht | 403/321 |
| 2,793,902 | 5/1957 | Govan, Jr. | 403/321 |
| 2,828,504 | 4/1958 | Nugent | 15/167.1 |
| 3,180,342 | 4/1965 | Dietsche | 15/160 |
| 5,138,733 | 8/1992 | Bock | 15/22.1 |

FOREIGN PATENT DOCUMENTS

| | | | |
|---|---|---|---|
| 792601 | 1/1936 | France | 403/321 |
| 978271 | 4/1951 | France | 15/176.1 |
| 2595221 | 9/1987 | France | 15/167.1 |
| 2402521 | 7/1978 | Germany | 15/176.1 |
| 8126 | 7/1885 | United Kingdom | 15/176.5 |
| 216355 | 5/1924 | United Kingdom . | |
| 289614 | 9/1935 | United Kingdom | 15/176.4 |

*Primary Examiner*—Mark Spisich
*Attorney, Agent, or Firm*—Norman M. Cameron

[57] ABSTRACT

A toothbrush includes a handle and a brush head removably connected to the handle. There is a spring for biasing the brush head away from the handle. A latch normally secures the brush head on the handle. There is a release mechanism for selectively releasing the latch, whereby the spring ejects the brush head away from the handle.

7 Claims, 2 Drawing Sheets

TOOTHBRUSH WITH EJECTABLE HEAD

BACKGROUND OF THE INVENTION

This invention relates to toothbrushes, in particular to toothbrushes with removable brush heads.

Toothbrushes in common usage comprise a single piece with an elongated handle, typically of plastic, with an integral brush head having a plurality of bristles imbedded therein. When the bristles become worn or bent, as usually happens within a few months, the entire toothbrush is conventionally tossed into the garbage and a new one purchased. This is environmentally unsound because the relatively large amount of plastic in the handle is rarely recycled, but usually ends up adding even more material for landfill sites. Typically the plastic is made of petroleum derivatives, a finite resource.

In addition, it is not really possible to have one brush suitable for all purposes. For example, a softer brush is beneficial in the morning when the gums are more delicate. A more vigorous, that is harder, brush can be used in the afternoon. A medium brush is most appropriate for evening use. Various compromises have been tried including having different hardness of bristles on different portions of the brush head, but a compromise suitable for all times is not really possible. Therefore a person should have several toothbrushes for different proposes. This takes up a lot of space and adds considerable clutter to the washroom, particularly when the washroom must store the toothbrushes of several persons.

Toothbrushes with interchangeable brush heads have been developed in the past. For example, U.S. Pat. No. 5,138,733 to Bock describes an ultrasonic toothbrush with a removable head. The brush head includes a tapered tongue section which is flexible. The brush head has a nose section which incorporates a tapered recess. The brush head may be removed from the handle, but this requires a special tool.

U.S. Pat. No. 2,638,614 to Anderson and U.S. Pat. No. 2,668,973 to Glaza both illustrate toothbrushes with removable heads. In the Anderson Patent the brush head is retained on the handle by a hump which engages a corresponding detent in a finger. In the Glaza Patent the head is retained by a leaf spring which has a rib adapted to engage a notch in the head.

Other relevant patents include U.S. Pat. No. 1,859,425 to Bell, U.S. Pat. No. 2,111,880 to Waters, U.S. Pat. No. 2,228,754 to Cosby, British Patent No. 216,355 and German Patent 2,402,521.

The prior art shows that it is known to construct a toothbrush having a removable brush head and to retain that brush head on the handle with a flexible tongue and detent arrangement. However, removing the brush head from the brush is not always an easy task with the prior art references. In particular, it is not an operation which can be readily accomplished using one hand.

Accordingly, it is an object of the invention to provide an improved toothbrush with a removable brush head where rite brush head can be removed from the toothbrush very easily using only a single hand.

It is also an object of the invention to provide an improved toothbrush with replaceable brush heads which is simple and rugged in construction and economical to produce and market.

SUMMARY OF THE INVENTION

In accordance with these objects, there is provided according to the invention a toothbrush having a handle and a brush head removably connected to the handle. There is biasing means for biasing the brush head away from the handle. A latch secures the brush head on the handle. There is a release means for selectively releasing the latch, whereby the biasing means ejects the brush head away from the handle.

Preferably the handle has a distal end and the brush head has a longitudinal socket receiving the handle adjacent the distal end thereof, the socket having an inner end. The biasing means includes a spring between the distal end of the handle and the inner end of the socket.

The latch may include a leaf spring mounted on the handle near the distal end. The leaf spring has a projection thereon which releasably engages a shoulder on the brush head.

The means for selectively releasing may be a button connected to the leaf spring.

DESCRIPTION OF THE PREFERRED EMBODIMENTS

Figure 1:
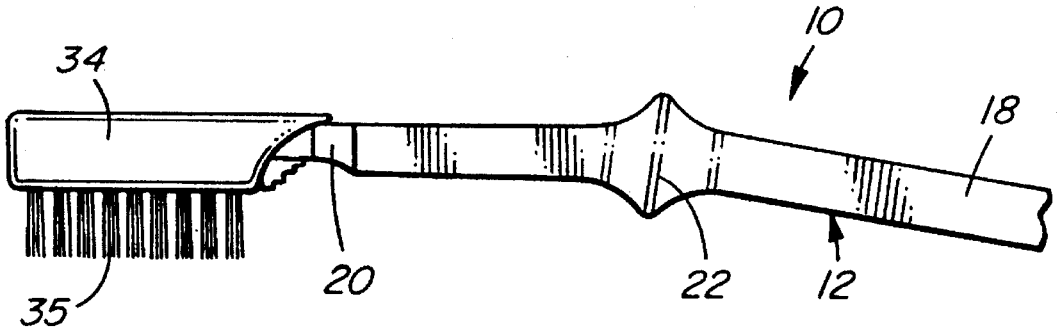
FIG. 1 is a side elevation of a toothbrush according to an embodiment of the invention with the handle partly broken away.

Referring first to FIG. 1, this shows a toothbrush 10 according to an embodiment of the invention. This toothbrush has a handle 12 which is generally conventional in configuration.

Figure 2:
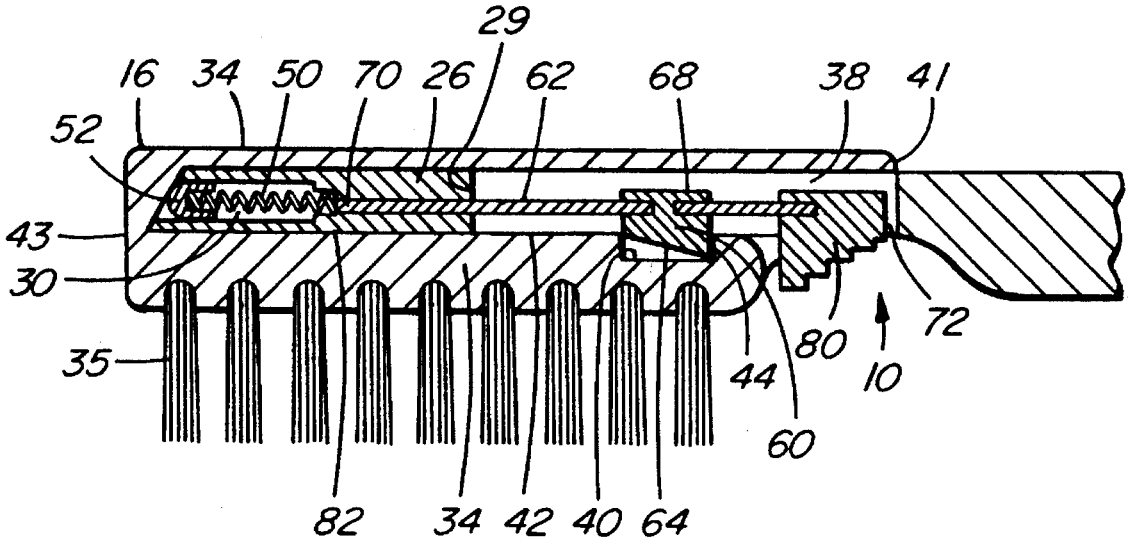
FIG. 2 is a fragmentary sectional view of the distal end of the handle and of the brush head thereof.
Figure 3:
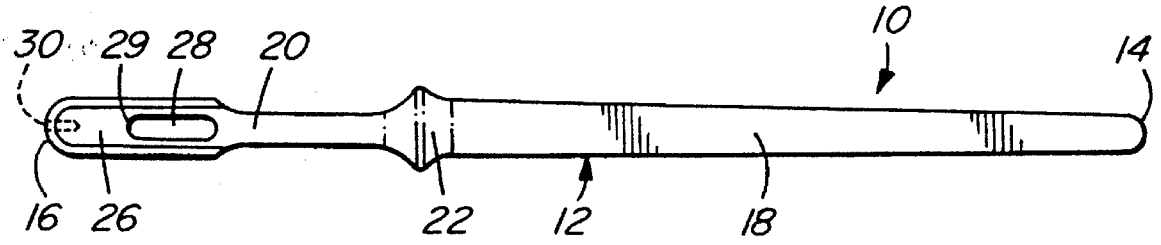
FIG. 3 is a bottom plan view of the handle thereof.

The handle has a proximal end 14, shown in FIG. 3, and a distal end 16, the latter being shown in FIG. 2 and 3. The handle includes a proximal portion 18 adjacent the proximal end 14 and a distal portion 20 adjacent distal end 16. The proximal and distal ends meet at a point 22 at an angle of approximately 10° in this embodiment. In other embodiments of the invention the portions may meet at a different angle or may be aligned.

The distal portion 20 of the handle has a tongue 26 best shown in FIG. 3. The tongue has straight sides, a rounded front and an aperture 28 extending therethrough from the top to the bottom of the toothbrush. The aperture 28 is elongated in the longitudinal direction of the toothbrush with parallel sides and rounded ends in this particular example.

There is also a cavity 30 in the handle extending inwardly from the distal end 16 along the longitudinal center line of the handle.

The toothbrush also includes a brush head 34 which is shown removably connected to the handle in FIG. 1 and 2. The brash head has bristles 35 and a longitudinal socket 38 extending inwardly from back end 41 thereof to near front end 43 thereof. The shape of the socket is generally complementary in shape to the tongue 26 of the handle for slidingly receiving the tongue therein as seen in FIG. 2. There is a recess 40 on bottom 42 of the socket, forming a shoulder 44.

Figure 5:
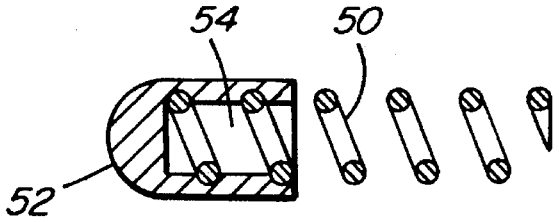
FIG. 5 is a simplified sectional view of the coil spring and rounded member thereof.

The toothbrush 10 has biasing means for biasing the brush head away from the handle which includes a coil spring 50 shown in FIG. 2 and in better detail in FIG. 5. There is a rounded member 52 on the end of the coil spring adjacent distal end 16 of the handle. The rounded member is bullet shaped in this example and has a cylindrical recess 54 receiving an end of the coil spring. The coil spring and rounded member are compressed within the socket 30 and biased against the brash head so as to tend to move the brush head away from the handle to the left from the point of view of FIG. 2. The spring is retained in the socket by an adhesive applied to its end opposite member 52.

Figure 4:
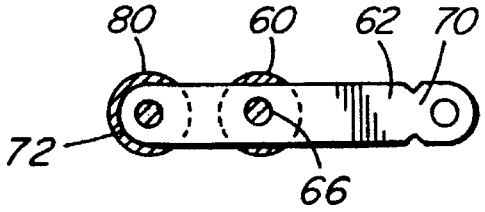
FIG. 4 is a top plan view of the leaf spring thereof.

However, the brush head is normally held in position on the handle by a latch in the form of a detent 60 mounted on a leaf spring 62 as shown on FIG. 2 and 4. The detent in this example is cylindrical with a sloped bottom 64 and releasably fits within the recess 40 of the brush head against shoulder 44. In this example the detent has a pin 66 extending through a corresponding aperture in the leaf spring and an enlarged head 68 to connect the detent to the leaf spring. The leaf spring has a front end 70 which is connected to the handle adjacent front end 29 of the aperture 28 therethrough. In this example the leaf spring is moulded into the handle. The leaf spring extends rearwardly within the aperture and has a back end 72.

The toothbrush also has a release means for selectively releasing the latch. In this example the release means is formed by a button 80 connected to the leaf spring adjacent its back end 72 in a manner similar to the detent 60. Like the detent, the button projects below bottom 82 of the tongue 26. However, the button is located rearwardly of the brush head on a side of the brush head opposite the distal end of the handle. Thus the button is accessible when the brush head is in place on the toothbrush.

The toothbrush is used in the conventional manner by the user until the user wishes to change the brush head 34. The user then pushes the button 80, typically using the thumb or one the fingers of the hand holding the toothbrush. The button is pushed upwards from the bottom of FIG. 2. This causes the leaf spring 62 to be deflected upwardly, disengaging detent 60 from shoulder 44 and recess 40 of the brush head. This causes the spring 50 and rounded member 52 in the cavity 30 to eject the brush head to the left from the point of view of FIG. 2.

The user then can replace the brush head by inserting the tongue 26 of the handle into the socket 38 of the brush head. The brush head is pushed onto to the tongue of the handle until the spring 50 is compressed mad the detent 60 falls into position against shoulder 44. The toothbrush is then ready is to be used again.

It is contemplated that the toothbrush will be included in a kit with a handle and six interchangeable heads with a range of three different types of bristles, namely soft, medium and hard.

The leaf spring and other components can be made of metal for a more durable product. However, a less expensive product can be made entirely of plastic. It will be understood by someone skilled in the art that many of the details provided above are by way of example only and are not intended to limit the scope of the invention which is to be interpreted with reference to the following claims.

What is claimed is:

1. A toothbrush comprising:

a handle having a distal end;

a brush head removably connected to the handle, the brush head having a longitudinal socket receiving the handle adjacent the distal end thereof, the socket having an inner end;

biasing means for biasing the brush head away from the handle, the biasing means including a coil spring between the distal end of the handle and the inner end of the socket, the spring being received in a cavity in the distal end of the handle, and a rounded member connected to the spring;

a latch securing the brush head onto the handle; and a release means for selectively releasing the latch, whereby the biasing means ejects the brush head away from the handle.

2. A toothbrush as claimed in claim 1, wherein the latch includes a leaf spring mounted on the handle, the leaf spring having a projection thereon which releasably engages a shoulder on the brush head.

3. A toothbrush as claimed in claim 2, wherein the means for selectively releasing is a button connected to the leaf spring.

4. A toothbrush as claimed in claim 3, wherein the handle has an aperture therethrough adjacent the distal end, the leaf spring being within the aperture, the projection and the button extending outwardly from the aperture beyond the handle.

5. A toothbrush as claimed in claim 4, wherein the brush head has a recess within the socket, the shoulder being between the socket and the recess, the projection extending into the recess when the brush head is connected to the handle.

6. A toothbrush as claimed in claim 5, wherein the button extends away from the handle on a side of the brush head opposite the distal end when the brush head is connected to the handle.

7. A toothbrush as claimed in claim 1, wherein the handle has a proximal end opposite the distal end, a distal portion adjacent the distal end and a proximal portion adjacent the proximal end, the distal portion and the proximal portion being at an angle of 10° relative to each other.

* * * * *